US010544958B2

(12) United States Patent
Makino et al.

(10) Patent No.: US 10,544,958 B2
(45) Date of Patent: Jan. 28, 2020

(54) AIR CONDITIONER WITH DEFROST CONTROL

(71) Applicant: DAIKIN INDUSTRIES, LTD., Osaka-shi, Osaka (JP)

(72) Inventors: Tatsuya Makino, Osaka (JP); Keitarou Hoshika, Osaka (JP); Naoki Moroi, Osaka (JP); Hiroshi Nakashima, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 15/534,808

(22) PCT Filed: Nov. 4, 2015

(86) PCT No.: PCT/JP2015/005534
§ 371 (c)(1),
(2) Date: Jun. 9, 2017

(87) PCT Pub. No.: WO2016/103552
PCT Pub. Date: Jun. 30, 2016

(65) Prior Publication Data

US 2017/0321939 A1 Nov. 9, 2017

(30) Foreign Application Priority Data

Dec. 26, 2014 (JP) ..... 2014-265924

(51) Int. Cl.
*F25B 13/00* (2006.01)
*F24F 11/89* (2018.01)
(Continued)

(52) U.S. Cl.
CPC ..... *F24F 11/89* (2018.01); *F24F 11/42* (2018.01); *F25B 13/00* (2013.01); *F25B 47/02* (2013.01);
(Continued)

(58) Field of Classification Search
CPC ..... F25B 47/025; F25B 47/02; F25B 47/022; F24F 11/41
See application file for complete search history.

(56) References Cited

U.S. PATENT DOCUMENTS 4,770,000 A * 9/1988 Kuroda ..... F25B 13/00 62/156
4,774,813 A * 10/1988 Yokoyama ..... F25B 13/00 62/156
(Continued)

FOREIGN PATENT DOCUMENTS

JP 3-195877 A 8/1991
JP 4-3865 A 1/1992
(Continued)

OTHER PUBLICATIONS

International Search Report for PCT/JP2015/005534 (PCT/ISA/210) dated Feb. 2, 2016.
(Continued)

*Primary Examiner* — Nelson J Nieves
(74) *Attorney, Agent, or Firm* — Birch, Stewart, Kolasch & Birch, LLP

(57) ABSTRACT

Stress to be imposed on a compressor in reverse cycle operation is reduced. A cycle controller causes an outdoor heat exchanger to function as a condenser and an indoor heat exchanger to function as an evaporator when a reverse cycle executing condition is met, so that a refrigerant circulates in reverse of a heating cycle. A rotation speed controller adjusts a rotation speed of a compressor in a reverse cycle, depending on an index correlated with an amount of frost on the outdoor heat exchanger at a start of the reverse cycle. The rotation speed controller decreases the rotation speed of the compressor in the reverse cycle as the index at the start of
(Continued)

the reverse cycle indicates that the amount of the frost on the outdoor heat exchanger is smaller.

6 Claims, 2 Drawing Sheets

(51) Int. Cl.
*F25B 47/02* (2006.01)
*F25B 49/02* (2006.01)
*F24F 11/42* (2018.01)

(52) U.S. Cl.
CPC ..... *F25B 47/025* (2013.01); *F25B 49/022* (2013.01); *F25B 2313/029* (2013.01); *F25B 2500/08* (2013.01); *F25B 2500/26* (2013.01); *F25B 2500/28* (2013.01); *F25B 2500/31* (2013.01); *F25B 2600/025* (2013.01); *F25B 2600/0253* (2013.01); *F25B 2600/2513* (2013.01)

(56) References Cited

U.S. PATENT DOCUMENTS 4,901,534 A * 2/1990 Nakatsuno ..... F25B 47/022 62/155
5,186,016 A * 2/1993 Nigo ..... F24F 11/00 62/150
5,319,943 A * 6/1994 Bahel ..... F24F 1/0003 62/156
5,704,217 A * 1/1998 Itoh ..... B60H 1/3207 236/49.3
5,970,727 A * 10/1999 Hiraoka ..... F25B 13/00 62/156
6,047,554 A * 4/2000 Choi ..... F25D 21/006 62/154
2004/0003604 A1* 1/2004 So ..... F25B 13/00 62/156
2007/0033955 A1* 2/2007 Luo ..... F25B 47/025 62/150
2007/0251256 A1* 11/2007 Pham ..... F04C 29/042 62/324.1
2009/0266093 A1* 10/2009 Aoki ..... F25B 47/025 62/155
2012/0060530 A1* 3/2012 Shimoda ..... F25B 13/00 62/132
2013/0091882 A1* 4/2013 Cho ..... F25B 13/00 62/156
2015/0075192 A1* 3/2015 Wasa ..... F25B 13/00 62/80
2015/0300723 A1* 10/2015 Tsukino ..... F25B 47/025 62/128
2015/0314668 A1* 11/2015 Suzuki ..... F25B 1/10 62/160
2016/0082810 A1* 3/2016 Suzuki ..... B60H 1/00921 62/151
2016/0178261 A1* 6/2016 Kimura ..... F25B 13/00 62/155
2016/0223236 A1* 8/2016 Kimura ..... F24F 3/065
2016/0238297 A1* 8/2016 Nuno ..... F25B 13/00
2016/0273816 A1* 9/2016 Horiuchi ..... F25B 47/025
2016/0320117 A1* 11/2016 Kanazawa ..... F25B 13/00
2017/0038125 A1* 2/2017 Tani ..... F24F 11/89
2017/0074577 A1* 3/2017 Hamada ..... F24F 13/222
2017/0284717 A1* 10/2017 Suzuki ..... F25B 47/025

FOREIGN PATENT DOCUMENTS

JP 7-139857 A 6/1995
JP 8-226715 A 9/1996
JP 2000-035265 A 2/2000
JP 2003-65638 A 3/2003
JP 2009-92335 A 4/2009
JP 2009-109165 A 5/2009
JP 2010054145 A * 3/2010

OTHER PUBLICATIONS

Written Opinion of the International Searching Authority for PCT/JP2015/005534 (PCT/ISA/237) dated Feb. 2, 2016.
Extended European Search Report dated Aug. 9, 2018 in corresponding European Application No. 15872133.2.

* cited by examiner

AIR CONDITIONER WITH DEFROST CONTROL

TECHNICAL FIELD

The present invention relates to an air conditioner which performs reverse cycle operation that involves circulating a refrigerant in reverse of heating operation.

BACKGROUND ART

An air conditioner includes a refrigerant circuit having: a compressor; an outdoor heat exchanger; an expansion valve; and an indoor heat exchanger all of which are connected in the stated order. In heating operation, the outdoor heat exchanger functions as an evaporator, and the indoor heat exchanger functions as a condenser. The refrigerant circuit provides a heating cycle in which the refrigerant circulates in the order of the compressor, the indoor heat exchanger, the expansion valve, and the outdoor heat exchanger.

In the heating cycle, outdoor air is cooled by the refrigerant in the outdoor heat exchanger, such that the outdoor heat exchanger can be frosted. To overcome the problem, Patent Document 1 discloses the following technique: when frosting of an outdoor heat exchanger is detected, the technique allows the rotation speed of a compressor to drop while heating operation is maintained, and keeps the outdoor heat exchanger from further frost.

CITATION LIST

Patent Document

Patent Document 1: Japanese Unexamined Patent Publication No. 04-003865

SUMMARY OF THE INVENTION

Technical Problem

Reverse cycle operation is known as a technique to operate an outdoor heat exchanger as a condenser and an indoor heat exchanger as an evaporator so as to circulate a refrigerant in reverse of a heating cycle. In the reverse cycle operation, the outdoor heat exchanger dissipates heat outward. Even with the technique cited in Patent Document 1, the reverse cycle operation is performed unless the outdoor heat exchanger defrosts.

However, except when the outdoor heat exchanger is frosted, the reverse cycle operation can be performed at regular time intervals (performed periodically) to return lubricant, which has flowed from a compressor out to the refrigerant circuit, to the compressor. During the reverse cycle operation, the compressor operates at a relatively high rotation speed which allows the outdoor heat exchanger to defrost. Hence, the compressor inevitably operates at a high rotation speed for every reverse cycle operation, regardless of how actually the outdoor heat exchanger is frosted. As a result, the compressor suffers from such stresses as a rise in its internal temperature and the refrigerant flowing back to the compressor, causing possible malfunction of the compressor.

The present invention is conceived in view of the above problems, and intended to reduce unnecessary stress to be imposed on a compressor in reverse cycle operation.

Solution to the Problem

A first aspect of the present invention provides an air conditioner including: a refrigerant circuit (20) including: a compressor (21); a outdoor heat exchanger (23); an expansion valve (24); and an indoor heat exchanger (25) all of which are connected in a stated order; a cycle controller (32*a*) causing either (i) the outdoor heat exchanger (23) to function as an evaporator and the indoor heat exchanger (25) to function as a condenser to create a heating cycle in the refrigerant circuit (20) or (ii) the outdoor heat exchanger (23) to function as the condenser and the indoor heat exchanger (25) to function as the evaporator when a reverse cycle executing condition is met, to create a reverse cycle in the refrigerant circuit (20), so that the refrigerant circulates in reverse of the heating cycle; and a rotation speed controller (32*b*) adjusting a rotation speed of the compressor (21) in the reverse cycle, depending on an index correlated with an amount of frost on the outdoor heat exchanger (23) at a start of the reverse cycle, the rotation speed controller (32*b*) decreasing the rotation speed of the compressor (21) in the reverse cycle as the index at the start of the reverse cycle indicates that the amount of the frost on the outdoor heat exchanger (23) is smaller.

The index for the amount of the frost on the outdoor heat exchanger (23) includes an outdoor temperature Ta, and a temperature Tr of an outside surface of the outdoor heat exchanger (23). Here, when the reverse cycle in which the refrigerant is circulated in reverse of the heating cycle is created in the refrigerant circuit (20), the rotation speed of the compressor (21) in the reverse cycle is adjusted, depending on the index for the amount of the frost on the outdoor heat exchanger (23) at the start of the reverse cycle. In particular, the rotation speed of the compressor (21) in the reverse cycle is reduced as the index indicates that the amount of frost on the outdoor heat exchanger (23) is smaller. Specifically, the rotation speed of the compressor (21) is increased as the amount of frost formed on the outdoor heat exchanger (23) is larger at the start of the reverse cycle. In contrast, the rotation speed of the compressor (21) is decreased as the amount of frost formed on the outdoor heat exchanger (23) is smaller in the reverse cycle. Hence, when the reverse cycle is created in the refrigerant circuit (20), such features keep the compressor (21) from running at an unnecessarily high rotation speed and allow the compressor (21) to run at an as-needed rotation speed, reducing the risk that the compressor (21) runs under unnecessary stress.

A second aspect of the invention according to the first aspect is directed to the air conditioner wherein the rotation speed controller (32*b*) may re-adjust the rotation speed of the compressor (21) in the reverse cycle, depending on the index in the reverse cycle.

Here, the rotation speed of the compressor (21) during the reverse cycle is re-adjusted, depending on how much frost is found in the reverse cycle. Such a feature makes it possible to reliably defrost the outdoor heat exchanger (23), and reduce the risk that the compressor (21) in the reverse cycle runs under unnecessary stress.

A third aspect of the invention according to the first and second aspects is directed to the air conditioner which may further include: an opening adjuster (32*c*) decreasing an opening of the expansion valve (24) in accordance with the amount of the frost on the outdoor heat exchanger (23), so that the opening decreased becomes smaller than the opening when the compressor (21) runs at a highest rotation speed in the reverse cycle, as the index at the start of the reverse cycle indicates that the amount of the frost on the outdoor heat exchanger (23) is smaller.

For example, if the opening of the expansion valve (24) is large even though just a small amount of frost is formed on the outdoor heat exchanger (23), fluid flow back; that is a liquid refrigerant inevitably flowing back into the compressor (21) in the reverse cycle, can occur depending on cases. As a countermeasure, in the third aspect, the opening of the expansion valve (24) is decreased as the amount of frost is smaller on the outdoor heat exchanger (23) at the start of the reverse cycle, contributing to reduction in occurrence of the fluid flow back. Such a feature may reduce the risk that the compressor (21) runs under excessive stresses due to the occurrence of the fluid flow back.

A fourth aspect of the invention according to the third aspect is directed to the air conditioner wherein the opening adjuster (32*c*) may re-adjust the opening of the expansion valve (24) in the reverse cycle, depending on the index in the reverse cycle.

Here, the opening of the expansion valve (24) during the reverse cycle is re-adjusted, depending on how much frost is found in the reverse cycle. Such a feature may further reduce the risk that the compressor (21) runs under excessive stress due to, for example, the occurrence of the fluid flow back.

A fifth aspect of the invention according to the first to fourth aspects is directed to the air conditioner wherein the amount of the frost on the outdoor heat exchanger (23) may be determined whether the index meets a predetermined condition. The air conditioner may further include an receiver (40) capable of receiving a change in the predetermined condition.

Such a feature makes it possible to appropriately adjust the rotation speed of the compressor, depending on an environment in which the air conditioner (10) is installed (21), by changing a predetermined condition in accordance with the environment.

Advantages of the Invention

The present invention may reduce the risk that the compressor (21) in the reverse cycle runs under unnecessary stress.

The second aspect of the invention makes it possible to reliably defrost the outdoor heat exchanger (23), and reduce the risk that the compressor (21) in the reverse cycle runs under unnecessary stress.

The third aspect of the invention may reduce the risk that the compressor (21) runs under excessive stress due to the occurrence of the fluid flow back.

The fourth aspect of the invention may reduce the risk that the compressor (21) runs under excessive stress due to the occurrence of the fluid flow back.

The fifth aspect of the invention makes it possible to appropriately adjust the rotation speed of the compressor (21) in the reverse cycle, depending on an environment in which the air conditioner (10) is installed (21).

DESCRIPTION OF EMBODIMENTS

An embodiment of the present invention will now be described in detail with reference to the drawings. The following embodiment is merely an exemplary one in nature, and is not intended to limit the scope, applications, or use of the invention.

<<Embodiment>>

<General Description>

Figure 1:
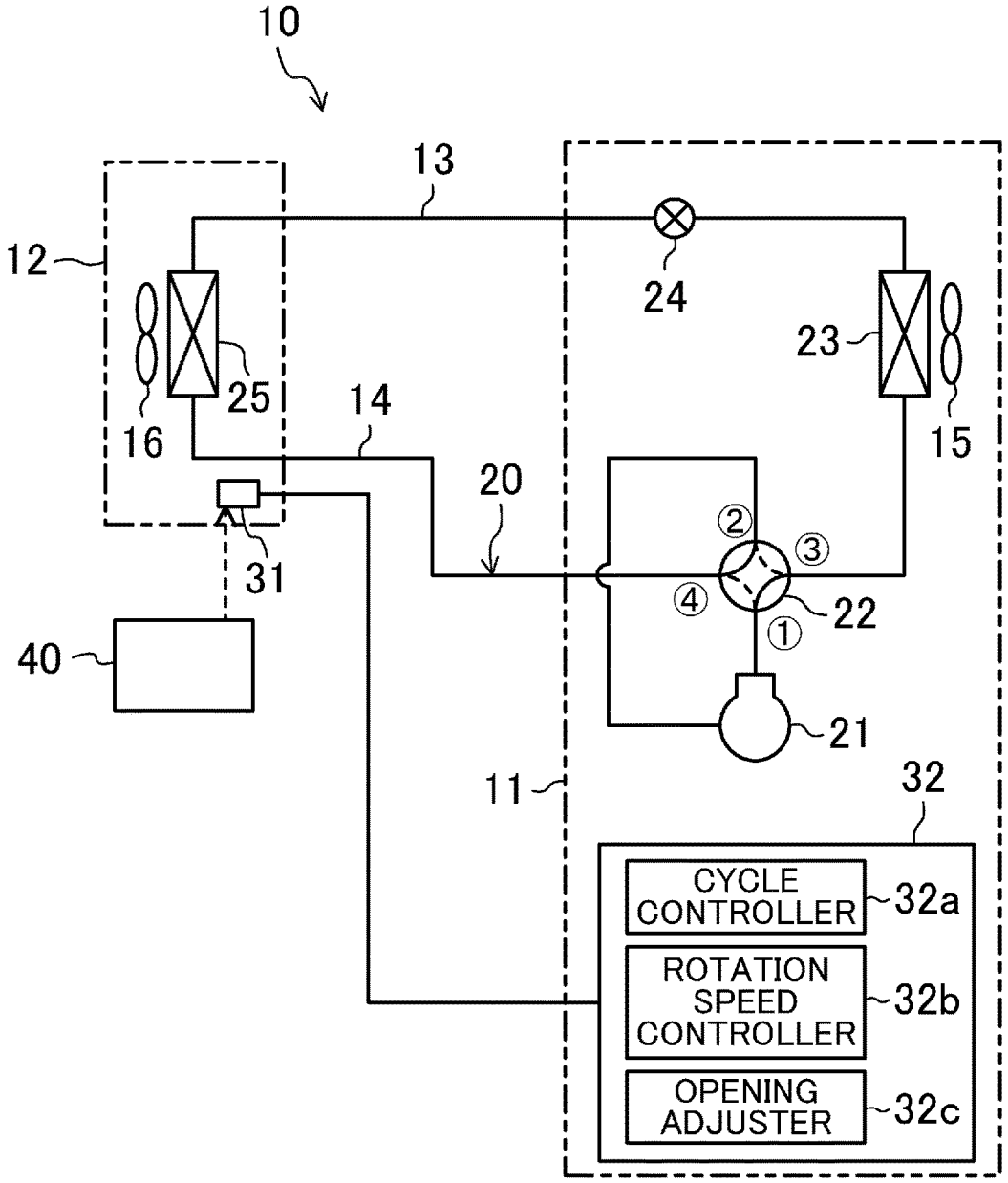
FIG. 1 is a schematic piping diagram illustrating a refrigerant circuit of an air conditioner.

As illustrated in FIG. 1, the air conditioner (10) includes: an outdoor unit (11); an indoor unit (12); an indoor controller (31); an outdoor controller (32); and a remote controller (40). The outdoor unit (11) and the indoor unit (12) are connected to each other via an interconnecting line for liquid (13), and an interconnecting line for gas (14). The outdoor unit (11), the indoor unit (12), the interconnecting line for liquid (13), and the interconnecting line for gas (14) form a refrigerant circuit (20).

This air conditioner (10) may perform reverse cycle operation other than cooling operation and heating operation. The reverse cycle operation is mainly for keeping an outdoor heat exchanger (23), included in the outdoor unit (11), from frost or for defrosting the frosted outdoor unit (11). However, the reverse cycle operation is performed also for returning lubricant, which has flowed from the compressor (21) out to the refrigerant circuit (20), to the compressor (21). In the reverse cycle operation, the refrigerant circulates inside the refrigerant circuit (20) in the direction as seen in the cooling operation; that is, in the opposite direction of the heating operation.

Note that the reverse cycle operation will be described later in detail.

<Configurations>

—Refrigerant Circuit—

As illustrated in FIG. 1, the refrigerant circuit (20) mainly includes: the compressor (21); a four-way switching valve (22); the outdoor heat exchanger (23); an expansion valve (24); and an indoor heat exchanger (25), all of which are connected in the stated order. The compressor (21), the four-way switching valve (22), the outdoor heat exchanger (23), and the expansion valve (24) are provided to the outdoor unit (11). The outdoor unit (11) is also provided with an outdoor fan (15) for supplying outdoor air to the outdoor heat exchanger (23). The indoor heat exchanger (25) is provided to the indoor unit (12). Furthermore, the indoor unit (12) is provided with an indoor fan (16) for supplying indoor air to the indoor heat exchanger (25).

The compressor (21) has a discharge side connected to a first port of the four-way switching valve (22) via a discharge pipe. The compressor (21) has a suction side connected to a second port of the four-way switching valve (22) via a suction pipe. Moreover, arranged along the refrigerant circuit (20) are the outdoor heat exchanger (23), the expansion valve (24), and the indoor heat exchanger (25) in the order from a third port toward a fourth port of the four-way switching valve (22).

The compressor (21) is a scroll or rotary hermetic compressor. The compressor (21) adopted for this embodiment is a variable capacity compressor capable of changing its capacity by changing its rotation speed (an operation frequency).

The four-way switching valve (22) switches between a first state and a second state. In the first state, the first port communicates with the third port, and the second port communicates with the fourth port (i.e., the state illustrated in FIG. 1 with solid curves). In the second state, the first port communicates with the fourth port, and the second port communicates with the third port (i.e., the state illustrated in FIG. 1 with dashed curves).

The expansion valve (24), namely an electronic expansion valve, decompresses the refrigerant. An opening of the expansion valve (24) is changed by the outdoor controller (32) which will be described later.

The outdoor heat exchanger (23) is a cross-fin fin-and-tube heat exchanger. The outdoor heat exchanger (23) functions as a condenser for the refrigerant in the cooling operation and the reverse cycle operation, and as an evaporator for the refrigerant in the heating operation.

Similar to the outdoor heat exchanger (23), the indoor heat exchanger (25) is a cross-fin fin-and-tube heat exchanger. The indoor heat exchanger (25) functions as an evaporator for the refrigerant in the cooling operation and the reverse cycle operation, and as a condenser for the refrigerant in the heating operation.

—Various Controllers—

As illustrated in FIG. 1, the indoor controller (31) is provided to the indoor unit (12), and the outdoor controller (32) is provided to the outdoor unit (11). Each of the indoor controller (31) and the outdoor controller (32) is a microcomputer including a central processing unit (CPU) and a memory. The indoor controller (31) and the outdoor controller (32) perform various kinds of control with the CPUs executing various kinds of processing on various programs stored in the memories.

The indoor controller (31) controls a volume of air supplied from the indoor fan (16). For example, in the heating operation and the cooling operation, the indoor controller (31) causes the indoor fan (16) to operate at a rotation speed which a user desires. Furthermore, in the reverse cycle operation, the indoor controller (31) may either suspend the operation of the indoor fan (16) or cause the indoor fan (16) to operate at a rotation speed lower than the rotation speed in the heating operation and the cooling operation.

Depending on operation speed control and an operation kind of the compressor (21), the outdoor controller (32) controls the connection and switch of the ports of the four-way switching valve (22), the opening of the expansion valve (24), and the operation of the outdoor fan (15). Note that the operation of the outdoor controller (32) will be described later in detail.

—Remote Controller—

The remote controller (40) (equivalent to a receiver) is mounted on such a place as a wall surface in a room. The remote controller (40) is capable of directly communicating with the indoor controller (31), and is communicably connected to the outdoor controller (32) via the indoor controller (31). Although not shown, the remote controller (40) includes various setting buttons and a display. The remote controller (40) is capable of receiving various settings entered by the user via the setting buttons and displaying details of the settings.

—Operation—

Described next is the air conditioner (10) in the heating operation and the reverse cycle operation.

—Heating Operation—

When the air conditioner (10) performs the heating operation, the heating cycle is created in the refrigerant circuit (20). In the heating cycle, the outdoor controller (32) switches the four-way switching valve (22) to the second state so that the outdoor heat exchanger (23) functions as an evaporator and the indoor heat exchanger (25) functions as a condenser. Such operation allows the four-way switching valve (22) to be switched as illustrated in the dashed arrow, and the heating cycle is created in the refrigerant circuit (20).

In the heating cycle, the refrigerant is compressed and discharged by the compressor (21), and then condensed and cooled by the indoor heat exchanger (25). The condensed and cooled refrigerant is decompressed by the expansion valve (24), and then dissipates heat through the outdoor heat exchanger (23) into outdoor air and evaporates. The evaporated refrigerant flows into the suction side of the compressor (21) via a not-shown accumulator.

—Reverse Cycle Operation—

As described above, the reverse cycle operation is mainly for keeping the outdoor heat exchanger (23) from frost or defrosting the outdoor heat exchanger (23). In the heating operation, moisture in the outdoor air adheres to, and forms frost on, an outside surface of the outdoor heat exchanger (23) working as an evaporator. This frost causes a decline in heat exchange capacity of the outdoor heat exchanger (23). Hence, the reverse cycle operation is performed during or after the heating operation. Moreover, when the reverse cycle operation is performed to return lubricant to the compressor (21), the reverse cycle operation is performed at regular time intervals (performed periodically).

In the reverse cycle operation, the cycle is reversed in the refrigerant circuit (20). In the reverse cycle, the outdoor controller (32) switches the four-way switching valve (22) to the first state so that, as also seen in the cooling operation, the outdoor heat exchanger (23) functions as a condenser and the indoor heat exchanger (25) functions as an evaporator. Such operation allows the four-way switching valve (22) to be switched as illustrated in the solid arrow of FIG. 1, and the cycle is reversed in the refrigerant circuit (20).

In the reverse cycle, the refrigerant is compressed and discharged by the compressor (21), and then condensed and cooled by the outdoor heat exchanger (23). The condensed and cooled refrigerant is decompressed by the expansion valve (24), and then dissipates heat through the indoor heat exchanger (25) into indoor air and evaporates. The evaporated refrigerant flows into the suction side of the compressor (21) via a not-shown accumulator.

<Controlling Reverse Cycle Operation>

Described below in detail is control performed by the outdoor controller (32) in the reverse cycle operation with reference to FIG. 2.

First, when a reverse cycle executing condition is met, a cycle controller (32*a*) of the outdoor controller (32) causes the reverse cycle to occur in the refrigerant circuit (20) (the reverse cycle operation). Examples of the reverse cycle executing condition includes conditions (I) and (II) below:

(I) a case where a predetermined period has passed since the end of the previous reverse cycle operation; and (II) a case where a temperature Tr of the outside surface of the outdoor heat exchanger (23) during or after the end of the heating operation is at or above an outdoor temperature Ta, a difference between the temperatures "Tr-Ta" is lower than a predetermined difference.

The condition (I) is for performing the reverse cycle operation to return the lubricant to the compressor (21). The condition (II) is for performing the reverse cycle operation to keep the outdoor heat exchanger (23) from frost or defrosting the outdoor heat exchanger (23).

When the condition (I) is met, the outdoor heat exchanger (23) might not be frosted. Now, when the condition (I) is met and the compressor (21) performs the reverse cycle operation, if the compressor (21) is run at the same rotation speed under the condition (II) in which the outdoor heat exchanger (23) is possibly frosted, the compressor (21) runs at a relatively high rotation speed. Here, the compressor (21) provides excessive compression capacity even though the outdoor heat exchanger (23) is not frosted. Inevitably, the compressor (21) is run under excessive stress. Furthermore, the noise of the compressor (21) increases with an increasing rotation speed of the compressor (21).

Figure 2:
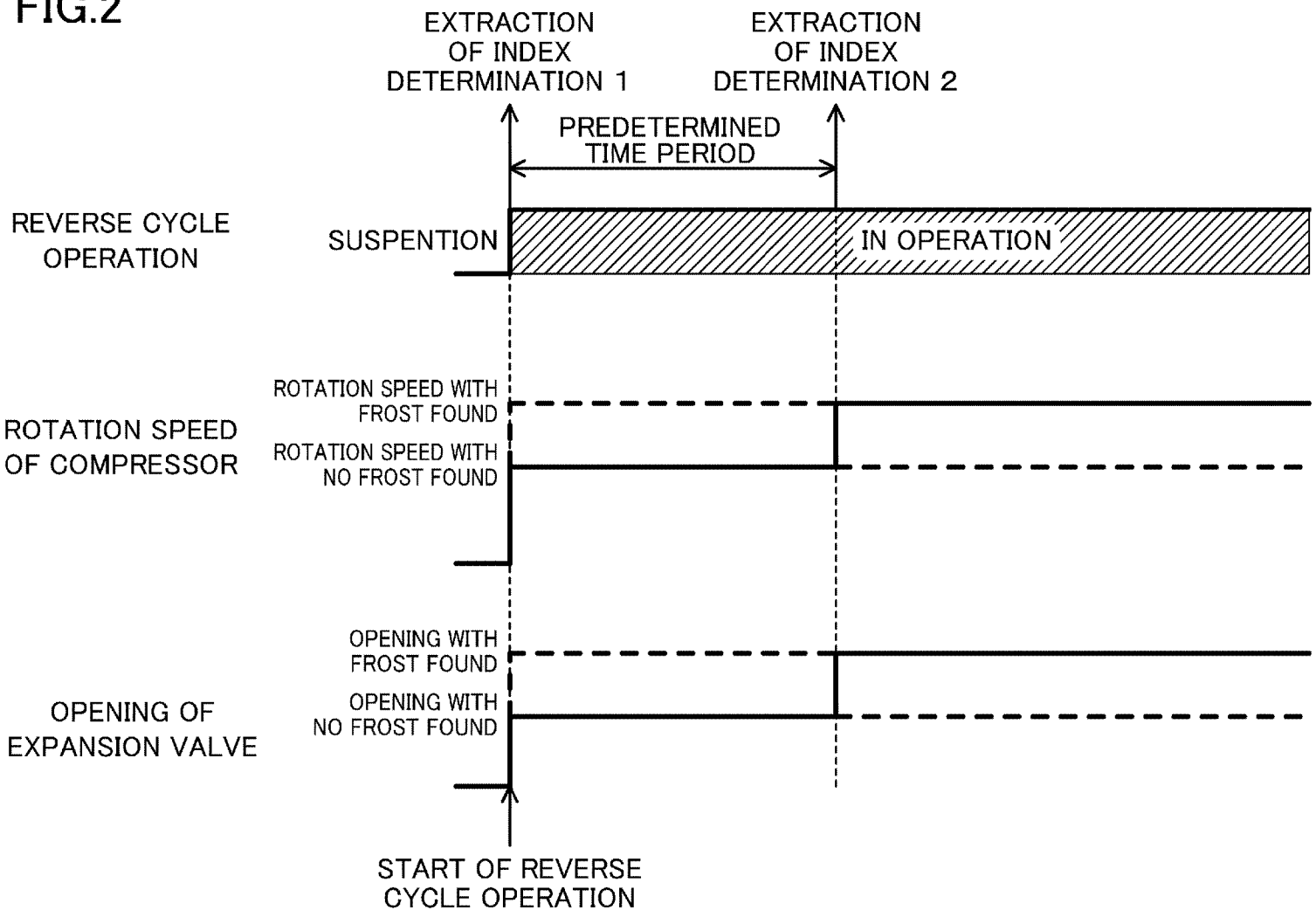
FIG. 2 is a timing diagram illustrating a rotation speed of a compressor and a temporal change in opening of expansion valve in reverse cycle operation.

Hence, as illustrated in FIG. 2, the outdoor controller (32) according to this embodiment performs control to adjust, for example, the rotation speed of the compressor (21) in the reverse cycle operation, depending on the actual amount of frost on the outdoor heat exchanger (23). In order to perform such control, the outdoor controller (32) also functions as a rotation speed controller (32*b*) and an opening adjuster (32*c*) as illustrated in FIG. 1, in addition to as the above cycle controller (32*a*).

—Rotation Speed Controller—

The rotation speed controller (32*b*) adjusts the rotation speed of the compressor (21) in the reverse cycle operation, depending on an index correlated with the amount of frost on the outdoor heat exchanger (23) at the start of the reverse cycle operation. In particular, the rotation speed controller (32*b*) decreases the rotation speed of the compressor (21) in the reverse cycle operation as the index at the start of the reverse cycle operation indicates that the amount of the frost on the outdoor heat exchanger (23) is smaller.

Here, "an index correlated with the amount of frost on the outdoor heat exchanger (23)" is a parameter having a value related to the actual amount of frost on the outdoor heat exchanger (23). Examples of the parameter include the outdoor temperature Ta, the temperature Tr of the outside surface of the outdoor heat exchanger (23), a value of a pressure sensor (not shown), and an actual evaporation temperature Te. For example, the rotation speed controller (32*b*) determines that the amount of frost on the outside surface of the outdoor heat exchanger (23) is smaller as the temperature Tr of the outside surface of the outdoor heat exchanger (23) is higher with respect to the outdoor temperature Ta. In contrast, the rotation speed controller (32*b*) determines that the amount of frost is greater as the temperature Tr of the outdoor heat exchanger (23) is lower with respect to the outdoor temperature Ta.

Specifically, in this embodiment, when the reverse cycle operation starts as either the condition (I) or the condition (II) is met, the rotation speed controller (32*b*) as illustrated in FIG. 2 extracts the index at the start of the reverse cycle operation, and determines how the outdoor heat exchanger (23) is frosted depending on the extracted index (Determination 1 in FIG. 2). Indexes to be extracted in the determination 1 are the outdoor air temperature Ta and the evaporation temperature Te. If the extracted indexes meet at least one of predetermined conditions (A) to (C), the rotation speed controller (32*b*) determines that the outdoor heat exchanger (23) is not frosted, and causes the compressor (21) to run at a rotation speed with no frost found (e.g., 51 rps).

$$Ta \geq X^\circ\ C. \tag{A}$$

$$Te \geq Y^\circ\ C. \tag{B}$$

$$Te \geq Ta + Z^\circ\ C. \tag{C}$$

If the extracted indexes in the determination 1 do not meet any of the predetermined conditions (A) to (C), the rotation speed controller (32*b*) determines that the outdoor heat exchanger (23) is frosted, and causes the compressor (21) to run at a rotation speed with frost found (e.g., 92 rps). Specifically, in this embodiment, the rotation speed with frost found (92 rps) is higher than the rotation speed with no frost found (51 rps).

Moreover, after a predetermined time period has elapsed since the start of the reverse cycle operation, the rotation speed controller (32*b*) re-extracts the indexes. Depending on the extracted indexes, the rotation speed controller (32*b*) re-determines (determination 2) how the outdoor heat exchanger (23) is frosted, and re-adjusts the rotation speed of the compressor (21) in the reverse cycle operation.

In this embodiment, the reverse cycle operation is performed for a certain time period (e.g., 10 minutes). The "predetermined time period" according to this embodiment is set exactly for a half of the predetermined time period (five minutes). Note that the predetermined time period does not have to be limited to a half of a certain time period; instead, the predetermined time period may be set for any given time period.

Here, the indexes to be re-extracted in the determination 2 may be either the same or different in kind as or from the indexes extracted in the determination 1 (at the start of the reverse cycle operation). This embodiment shows as an example a case where the indexes to be extracted in the determination 1 are different in kind from the indexes to be extracted in the determination 2. Specifically, the indexes to be extracted in the determination 2 are: a temperature Tr of the current outside surface of the outdoor heat exchanger (23); and a target temperature Tf of the outside surface of the outdoor heat exchanger (23) at the end of the reverse cycle operation.

Specifically, if the indexes to be extracted in the determination 2, at which after predetermined time period has passed since the reverse cycle operation, meet a predetermined condition below (D), the rotation speed controller (32*b*) determines that the outdoor heat exchanger (23) is not frosted, and adjusts the rotation speed of the running compressor (21) to a low rotation speed; namely, the rotation speed with no frost found (51 rps).

$$Tr \geq Tf + W^\circ\ C. \tag{D}$$

If the indexes extracted in the determination 2 do not meet the predetermined condition (D), the rotation speed controller (32*b*) determines that the outdoor heat exchanger (23) is frosted, and adjusts the rotation speed of the running compressor (21) to a high rotation speed; namely the rotation speed with frost found (92 rps).

As an example, the solid lines in FIG. 2 show the following case: The outdoor heat exchanger (23) is determined not to be frosted in the determination 1 at the start of the reverse cycle operation, such that the compressor (21) runs at the rotation speed with no frost found (51 rps); whereas, the outdoor heat exchanger (23) is determined to be frosted in the determination 2 after the predetermined time period has elapsed, such that the rotation speed of compressor (21) is increased to the rotation speed with frost found (92 rps). Specifically, the solid lines in FIG. 2 show an example that, since the outdoor heat exchanger (23) is frosted further by a certain influence from the start of the reverse cycle until the predetermined time period has elapsed, the rotation speed controller (32*b*) increases the rotation speed of the compressor (21) to 92 rps when the predetermined time period elapses, and defrosts the outdoor heat exchanger (23) during the remaining time period.

The broken lines in FIG. 2 show the following case: The outdoor heat exchanger (23) is determined to be frosted in the determination 1 at the start of the reverse cycle operation, such that that the compressor (21) runs at the rotation speed with frost found (92 rps); whereas, the outdoor heat exchanger (23) is determined not to be frosted in the determination 2 after the predetermined time period has elapsed, such that the rotation speed of the compressor (21) is decreased to the rotation speed with no frost found (51 rps). Specifically, the broken lines in FIG. 2 show an example that since the outdoor heat exchanger (23) is defrosted from the start of the reverse cycle until the predetermined time period has elapsed, the rotation speed controller (32*b*) decreases the rotation speed of the compressor (21) to 51 rps when the predetermined time period elapses.

Hence, in this embodiment, the rotation speed of the compressor (21) is set lower in the reverse cycle operation when the outdoor heat exchanger (23) is not frosted at the start of the reverse cycle operation than when the outdoor heat exchanger (23) is frosted. Such a feature keeps the compressor (21) in the reverse cycle operation from running at an unnecessarily high rotation speed, reducing the risk that the compressor (21) runs under unnecessary stress. Furthermore, in this embodiment, the rotation speed of the compressor (21) may be adjusted not only at the start of the reverse cycle operation but also during the reverse cycle operation. Such a feature may reduce the stress on the compressor (21) and reliably defrost the outdoor heat exchanger (23), depending on how the frost on the outdoor heat exchanger (23) has changed during the reverse cycle operation.

—Opening Adjuster—

In this embodiment, as illustrated in FIG. 2, not only the rotation speed of the compressor (21) but also the opening of the expansion valve (24) may be adjusted, depending on how the outdoor heat exchanger (23) is frosted. The opening adjuster (32*c*) decreases the opening of the expansion valve (24) as the indexes (the indexes according to the determination 1) at the start of the reverse cycle operation indicate that the amount of frost on the outdoor heat exchanger (23) is smaller. Specifically, as the amount of frost on the outdoor heat exchanger (23) is smaller, the opening of the expansion valve (24) is adjusted to be decreased because the compressor (21) runs at a lower rotation speed. Moreover, the opening adjuster (32*c*) re-adjusts the opening of the expansion valve (24) in the reverse cycle operation, depending on the indexes (the indexes according to the determination 2) in the reverse cycle operation.

Specifically, if the rotation speed controller (32*b*) determines in the determination 1 that the outdoor heat exchanger (23) is frosted, the opening adjuster (32*c*) adjusts the opening of the expansion valve (24) in the reverse cycle operation to an opening with frost found; that is, an opening corresponding to the rotation speed "92 rps" of the compressor (21) with frost found. In contrast, if the rotation speed controller (32*b*) determines in the determination 1 that the outdoor heat exchanger (23) is not frosted, the opening, adjuster (32*c*) adjusts the opening of the expansion valve (24) in the reverse cycle operation to an opening with no frost found; that is, an opening corresponding to the rotation speed "51 rps" of the compressor (21) with no frost found. The opening with no frost found is smaller than the opening with frost found. Hence, the opening of the expansion valve (24) when no frost is found is said to be smaller than the opening when the compressor (21) in the reverse cycle operation runs at the highest speed (92 rps) because the amount of the frost on the outdoor heat exchanger (23) reaches a highest level.

Specifically, if the rotation speed controller (32*b*) determines, between the determination 1 and the determination 2 made when the predetermined time period elapses, that the outdoor heat exchanger (23) is frosted, the opening adjuster (32*c*) re-adjusts the opening of the expansion valve (24) in the reverse cycle operation to the opening with frost found; that is, the opening corresponding to the rotation speed "92 rps" of the compressor (21) with frost found. In contrast, if the rotation speed controller (32*b*) determines in the determination 2 that the outdoor heat exchanger (23) is not frosted, the opening adjuster (32*c*) adjusts the opening of the expansion valve (24) in the reverse cycle operation to the opening with no frost found; that is, the opening corresponding to the rotation speed "51 rps" of the compressor (21) with no frost found.

As an example, the solid lines in FIG. 2 show the following case: The outdoor heat exchanger (23) is determined not to be frosted in the determination 1 at the start of the reverse cycle operation, such that the opening of the expansion valve (24) is an opening with no frost found; that is, the opening corresponding to the rotation speed "51 rps" of the compressor (21); whereas, the outdoor heat exchanger (23) is determined to be frosted in the determination 2 after the predetermined time period has elapsed, such that the opening of the expansion valve (24) is increased to an opening with frost found; that is the opening corresponding to the rotation speed "92 rps" of the compressor (21).

The broken lines in FIG. 2 show the following case: The outdoor heat exchanger (23) is determined to be frosted in the determination 1 at the start of the reverse cycle operation, such that the opening of the expansion valve (24) is an opening with frost found; that is, the opening corresponding to the rotation speed "92 rps" of the compressor (21); whereas, the outdoor heat exchanger (23) is determined not to be frosted in the determination 2 after the predetermined time period has elapsed, such that the opening of the expansion valve (24) is decreased to an opening with no frost found; that is the opening corresponding to the rotation speed "51 rps" of the compressor (21).

Hence, in this embodiment, the rotation speed of the compressor (21) in the reverse cycle operation is decreased and the opening of the expansion valve (24) in the reverse cycle operation is decreased when the outdoor heat exchanger (23) is not frosted at the start of the reverse cycle operation than when the outdoor heat exchanger (23) is frosted. Specifically, the opening of the expansion valve (24) in the reverse cycle operation corresponds to the compression capacity of the compressor (21). Thus, there is no such case in the reverse cycle operation where, for example, the rotation speed of the compressor (21) is low and the opening of the expansion valve (24) is large with respect to heat exchange capacity of the indoor heat exchanger (25) working as an evaporator. Such a feature may reduce the risk that the fluid flow back occurs; that is, in the reverse cycle operation, the indoor heat exchanger (25) cannot completely evaporate a liquid refrigerant condensed in the outdoor heat exchanger (23), and the non-evaporated liquid refrigerant inevitably flows back into the compressor (21). Furthermore, there is no such case either where the rotation speed of the compressor (21) is high or the opening of the expansion valve (24) is small. Such a feature may reduce the risk of a decrease in refrigeration capacity due to a decrease in evaporating pressure and an increase in degree of superheat of the refrigerant sucked into the compressor (21), followed by a decrease in efficiency in the reverse cycle operation.

As described above, in this embodiment, the amount of frost on the outdoor heat exchanger (23) at the start of the reverse cycle operation is determined whether the indexes extracted at the start of the reverse cycle operation meet either (i) at least one of the conditions (A) to (C) or (ii) none of the conditions (A) to (C). The amount of the frost on the outdoor heat exchanger (23) at the start of the reverse cycle operation is determined whether the indexes extracted in the reverse cycle operation meet the above condition (D). Beneficially, these predetermined conditions (A) to (D) may appropriately be determined, depending on an environment in which the air conditioner (10) is installed. This is because conditions in which the outdoor heat exchanger (23) is actually frosted differ whether the air conditioner (10) is installed in a cold climate.

Hence, even if the predetermined conditions (A) to (D) are previously stored in a memory of the outdoor controller (32) before shipment of the air conditioner (10), the remote controller (40) according to this embodiment may receive a change in the predetermined conditions (A) to (D) and overwrite the memory of the outdoor controller (32) with the change. The change in the predetermined conditions (A) to (D) is made, for example, by an installation technician when he or she installs the air conditioner (10). Such a feature makes it possible to appropriately adjust the rotation speed of the compressor (21) and the opening of the expansion valve (24) in the reverse cycle operation, depending on an environment in which the air conditioner (10) is installed.

Note that the reference signs X, Y, Z, and W of the above predetermined conditions (A) to (D) represent constants.

<Effects>

This embodiment involves adjusting the rotation speed of the compressor (21) in the reverse cycle operation, depending on an index to the amount of frost on the outdoor heat exchanger (23) at the start of the reverse cycle operation. In particular, the rotation speed of the compressor (21) in the reverse cycle operation is decreased as the index indicates that the amount of frost on the outdoor heat exchanger (23) is smaller. Specifically, the rotation speed of the compressor (21) is increased as the amount of frost formed on the outdoor heat exchanger (23) is larger at the start of the reverse cycle operation. In contrast, the rotation speed of the compressor (21) is decreased as the amount of frost formed on the outdoor heat exchanger (23) is smaller in the reverse cycle operation. In the reverse cycle operation, such features keep the compressor (21) from running at an unnecessarily high rotation speed and allow the compressor (21) to run at an as-needed rotation speed, reducing the risk that the compressor (21) runs under unnecessary stress.

Moreover, this embodiment involves re-adjusting the rotation speed of the compressor (21) during the reverse cycle operation, depending on how much frost is found in the reverse cycle operation. Such a feature makes it possible to reliably defrost the outdoor heat exchanger (23), and reduce the risk that the compressor (21) in the reverse cycle operation runs under unnecessary stress.

For example, if the opening of the expansion valve (24) is large even though just a small amount of frost is formed on the outdoor heat exchanger (23), fluid flow back; that is a liquid refrigerant inevitably flowing back into the compressor (21) in the reverse cycle, can occur depending on cases. As a countermeasure, in this embodiment, the opening of the expansion valve (24) is decreased as the amount of frost on the outdoor heat exchanger (23) is smaller at the start of the reverse cycle, contributing to reduction in occurrence of the fluid flow back. Such a feature may reduce the risk that the compressor (21) runs under excessive stresses due to the occurrence of the fluid flow back.

Moreover, this embodiment involves re-adjusting the opening of the expansion valve (24) during the reverse cycle execution, depending on how much frost is found in the reverse cycle. Such a feature may further reduce the risk that the compressor (21) runs under excessive stress due to, for example, the occurrence of the fluid flow back.

Furthermore, in this embodiment, the predetermined conditions (A) to (D) may be changed via the remote controller (40). Such a feature makes it possible to appropriately adjust the rotation speed of the compressor (21) in the reverse cycle operation and, further, the opening of the expansion valve (24) in the reverse cycle operation, depending on an environment in which the air conditioner (10) is installed.

<<Other Embodiments>>

The above embodiment may also have the configurations below.

In the above embodiment, the predetermined conditions (A) to (C) according to the determination 1 are different from the predetermined condition (D) according to the determination 2; however, an identical predetermined condition may be used for the determination 1 and the determination 2. For example, when a predetermined time period in FIG. 2 is as short as, for example, one minute, an identical predetermined condition may be used for the determination 1 and the determination 2. In this case, as a matter of course, an identical kind of index is used for the determination 1 and the determination 2.

In the above embodiment, FIG. 2 shows as an example that both the rotation speed of the compressor (21) and the opening of the expansion valve (24) in the reverse cycle operation are adjusted to either one of the two settings. However, the rotation speed of the compressor (21) and the opening of the expansion valve (24) in the reverse cycle operation may be fine-tuned, depending on the amount of frost on the outdoor heat exchanger (23). In this case, the rotation speed of the compressor (21) is adjusted lower and the opening of the expansion valve (24) is adjusted smaller as the amount on the outdoor heat exchanger (23) is smaller.

The re-adjustment of the rotation speed of the compressor (21) according to the determination 2 does not have to be made.

The re-adjustment of the opening of the expansion valve (24) according to the determination 1 does not have to be made.

The re-adjustment of the opening of the expansion valve (24) according to the determination 2 does not have to be made.

The specifications of the remote controller (40) do not have to allow a change in the predetermined conditions (A) to (C) according to the determination 1 and the predetermined condition (D) according to the determination 2. In this case, the determinations 1 and 2 are made based on a condition set before shipment of the air conditioner (10).

INDUSTRIAL APPLICABILITY

As can be seen, the present invention is useful for an air conditioner performing reverse cycle operation which involves circulating a refrigerant in reverse of heating operation.

DESCRIPTION OF REFERENCE CHARACTERS

10 Air Conditioner
20 Refrigerant Circuit
21 Compressor
23 Outdoor Heat Exchanger
24 Expansion Valve
25 Indoor Heat Exchanger
32*a* Cycle Controller
32*b* Rotation Speed Controller
32*c* Opening Adjuster
40 Remote Controller (Receiver)

The invention claimed is:

1. An air conditioner comprising:

a refrigerant circuit including: a compressor; an outdoor heat exchanger; an expansion valve; and an indoor heat exchanger all of which are connected in a stated order;

a cycle controller causing either (i) the outdoor heat exchanger to function as an evaporator and the indoor heat exchanger to function as a condenser to create a heating cycle in the refrigerant circuit or (ii) the outdoor heat exchanger to function as the condenser and the indoor heat exchanger to function as the evaporator when a reverse cycle executing condition is met, to create a reverse cycle in the refrigerant circuit, so that refrigerant circulates in reverse of the heating cycle;

a rotation speed controller configured to adjust a rotation speed of the compressor in the reverse cycle, depending on a first index correlated with an amount of frost on the outdoor heat exchanger at a start of the reverse cycle; and an opening adjuster configured to adjust an opening of the expansion valve, depending on the first index at the start of the reverse cycle, the rotation speed controller configured to decrease the rotation speed of the compressor in the reverse cycle as the first index at the start of the reverse cycle indicates that the amount of frost on the outdoor heat exchanger is decreasing, the opening adjuster configured to decrease the opening of the expansion valve in accordance with the amount of frost on the outdoor heat exchanger, so that the decreased opening is smaller than an opening when the compressor runs at a highest rotation speed in the reverse cycle, as the first index at the start of the reverse cycle indicates that the amount of frost on the outdoor heat exchanger has decreased, wherein the rotation speed controller is configured to re-adjust, during the reverse cycle, the rotation speed of the compressor after the start of the reverse cycle, depending on a second index, and the opening adjuster is configured to re-adjust, during the reverse cycle, the opening of the expansion valve after the start of the reverse cycle, depending on the second index.

2. The air conditioner of claim 1 wherein, the amount of frost on the outdoor heat exchanger is determined whether the first index meets a predetermined condition, and the air conditioner further comprising a receiver capable of receiving a change in the predetermined condition.

3. The air conditioner of claim 1, wherein the second index is based on a difference between a temperature of an outside surface of the outdoor heat exchanger and a target temperature of the outside surface of the outdoor heat exchanger.

4. The air conditioner of claim 3, wherein, the amount of frost on the outdoor heat exchanger is determined during the reverse cycle based on whether the second index meets a predetermined condition, and the air conditioner further comprises a receiver capable of receiving a change in the predetermined condition.

5. The air conditioner of claim 1 wherein, the first index at the start of the reverse cycle is based on a difference between an evaporation temperature and an outside air temperature.

6. The air conditioner of claim 5 wherein, the amount of the frost on the outdoor heat exchanger is determined at the start of the reverse cycle based on whether the first index meets a predetermined condition, and the air conditioner further comprises a receiver capable of receiving a change in the predetermined condition.

* * * * *